US007479194B2

(12) United States Patent
DeLuca

(10) Patent No.: US 7,479,194 B2
(45) **Date of Patent: *Jan. 20, 2009**

(54) DAMAGE TOLERANT MICROSTRUCTURE FOR LAMELLAR ALLOYS

(75) Inventor: Daniel P. DeLuca, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 306 days.

This patent is subject to a terminal disclaimer.

(21) Appl. No.: 11/200,397

(22) Filed: Aug. 8, 2005

(65) Prior Publication Data

US 2008/0163958 A1 Jul. 10, 2008

Related U.S. Application Data

(63) Continuation of application No. 10/378,171, filed on Mar. 3, 2003, now Pat. No. 6,974,507.

(51) Int. Cl.
*C22C 14/00* (2006.01)
*C22F 1/18* (2006.01)

(52) U.S. Cl. ..... 148/421; 148/669; 148/670; 148/671; 420/418; 420/419; 420/420; 420/421

(58) Field of Classification Search ..... 148/421, 148/669, 670, 671; 420/418, 419, 420, 421
See application file for complete search history.

(56) References Cited

U.S. PATENT DOCUMENTS

| | | | | |
|---|---|---|---|---|
| 5,545,265 | A * | 8/1996 | Austin et al. | 148/421 |
| 5,634,992 | A * | 6/1997 | Kelly et al. | 148/669 |
| 6,454,882 | B1 * | 9/2002 | Martin | 148/421 |
| 6,669,791 | B2 * | 12/2003 | Tetsui et al. | 148/421 |
| 2004/0094248 | A1 * | 5/2004 | Janschek et al. | 148/671 |

* cited by examiner

*Primary Examiner*—Roy King
*Assistant Examiner*—Lois L. Zheng
(74) *Attorney, Agent, or Firm*—Bachman & LaPointe, P.C.

(57) ABSTRACT

A damage tolerant microstructure for a lamellar alloy, such as a lamellar γTiAl alloy, is provided in accordance with the present invention. The alloy comprises a matrix and a plurality of grains or lamellar colonies, a portion of which exhibit a nonplanar morphology within said matrix. Each of the lamellar colonies contains a multitude of lamella with irregularly repeating order. The γTiAl platelets have a triangular (octahedral) unit cell and stack with γ twins. The $\alpha_2Ti_3Al$ platelets are irregularly interspersed. The unit cell for $\alpha_2Ti_3Al$ is hexagonal. Each of the layers has a curved, nonplanar structure for resisting crack formation and growth.

8 Claims, 4 Drawing Sheets

100x

DAMAGE TOLERANT MICROSTRUCTURE FOR LAMELLAR ALLOYS

CROSS-REFERENCE TO RELATED APPLICATION(S)

This application is a continuation of U.S. patent application Ser. No. 10/378,171 filed Mar. 3, 2003, now U.S. Pat. No. 6,974,507.

STATEMENT OF GOVERNMENT INTEREST

The Government of the United States of America may have rights in the present invention pursuant to Contract No. F33615-94-C-2422 awarded by the Department of the Air Force.

BACKGROUND OF THE INVENTION

The present invention relates to a damage tolerant microstructure for lamellar alloys and to a method of producing same.

The current microstructure of lamellar γTiAl alloys is composed of an equiaxed (prior β) grain structure with planar lamella as shown in FIG. 1. The grains or lamellar colonies themselves exhibit a lamellar stack of TiAl (γ) and $Ti_3Al$ ($\alpha_2$) platelets such as that shown schematically in FIG. 2. Interlaminar or intralaminar shear between the layers of the lamellar stack has been identified in fatigue and fracture tests as one of the principal mechanisms leading to monotonic and cyclic crack formation, such as that shown in FIG. 3, in gamma TiAl alloys possessing a lamellar microstructure. High and low cycle fatigue fractures and near threshold small crack growth test fractures show interlaminar shear at their failure origins below 1200 degrees Fahrenheit.

SUMMARY OF THE INVENTION

It is an object of the present invention to provide a damage tolerant microstructure for lamellar alloys such as lamellar TiAl alloys.

It is a further object of the present invention to provide a method for providing a damage tolerant microstructure for lamellar alloys such as lamellar γTiAl alloys.

The foregoing objects are attained by the present invention.

In accordance with the present invention, a damage tolerant microstructure for lamellar γTiAl alloys broadly comprises a matrix and a plurality of lamellar colonies within said microstructure having a nonplanar morphology.

In accordance with the present invention, a method for forming a damage tolerant microstructure for lamellar alloys broadly comprises the steps of casting the alloy and extruding the cast alloy at a temperature in the range of 1290 to 1315 degrees Centigrade at an extrusion ratio in the range of from 90:1 to 100:1.

Other details of the damage tolerant microstructure for lamellar alloys of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Lamellar γTiAl alloys in accordance with the present invention have a microstructure exhibiting a plurality of grains referred to as lamellar colonies having a nonplanar morphology within the matrix. The alloys may also have planar grains within the matrix as well as the lamellar colonies having the nonplanar morphology. The lamellar colonies having a nonplanar morphology typically include many stacked layers, each with a curved or non-planar structure. In a γTiAl alloy, some of these layers consist of TiAl (γ) and other layers consist of $Ti_3Al$ ($\alpha_2$). Each of the lamellar colonies contains a multitude of lamella with irregularly repeating order. The γTiAl platelets have a triangular (octahedral) unit cell and stack with γ twins. The $\alpha_2Ti_3Al$ platelets are irregularly interspersed. The unit cell for $\alpha_2Ti_3Al$ is hexagonal. By forming layers with a curved or non-planar structure, the grains are better able to resist crack formation caused by interlaminar or intralaminar shear.

In a preferred embodiment of the present invention, the lamellar colonies having a nonplanar morphology comprise at least 10% of the lamellar colonies within the matrix and are located along outer edges of the matrix. By having the lamellar colonies with the nonplanar morphology at the outer edges, the alloy becomes more resistant to fatigue damage. Further, in a preferred embodiment of the present invention, the lamellar colonies having the nonplanar morphology have a fine structure with average grain sizes being in the range of 0.8 to 1.09 microns. Fine grain structures are desirable because they are more resistant to the formation of deleterious cracks which lead to failure of the alloy.

Lamellar alloys, such as γ TiAl alloys, having the advantageous nonplanar morphology may be formed by vacuum arc melting the alloy constituents, casting the alloy into a bar or strip stock, and extruding the cast alloy at a temperature in the range of from 1290 degrees Centigrade to 1315 degrees Centigrade and at an extrusion ratio in the range of 90:1 to 100:1. Any suitable extrusion device known in the art may be used to perform the extrusion step.

Figure 1:
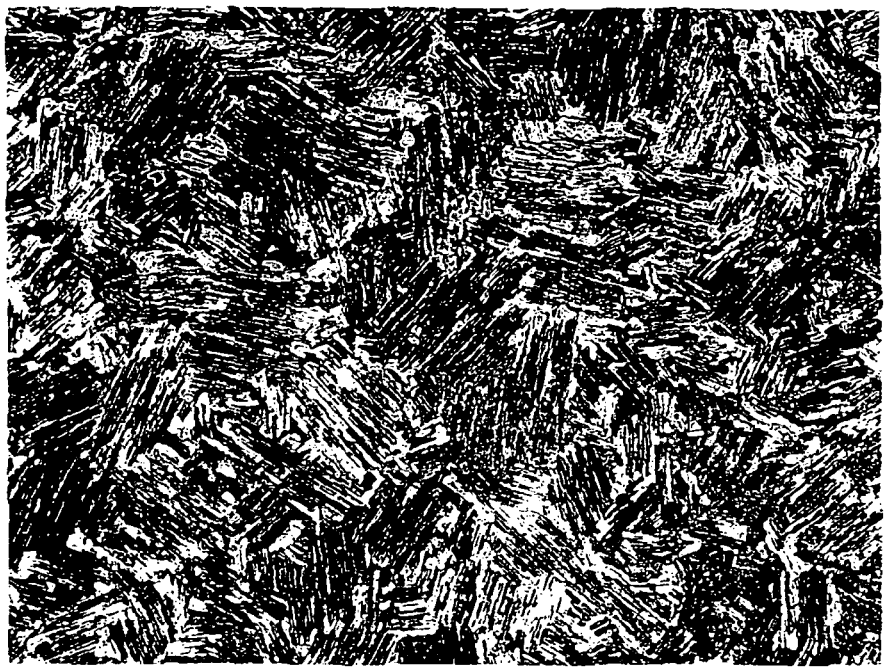
FIG. 1 (PRIOR ART)
FIG. 1 is a photomicrograph showing the microstructure of a conventional fully lamellar γTiAl alloy having all planar lamella.
Figure 3:
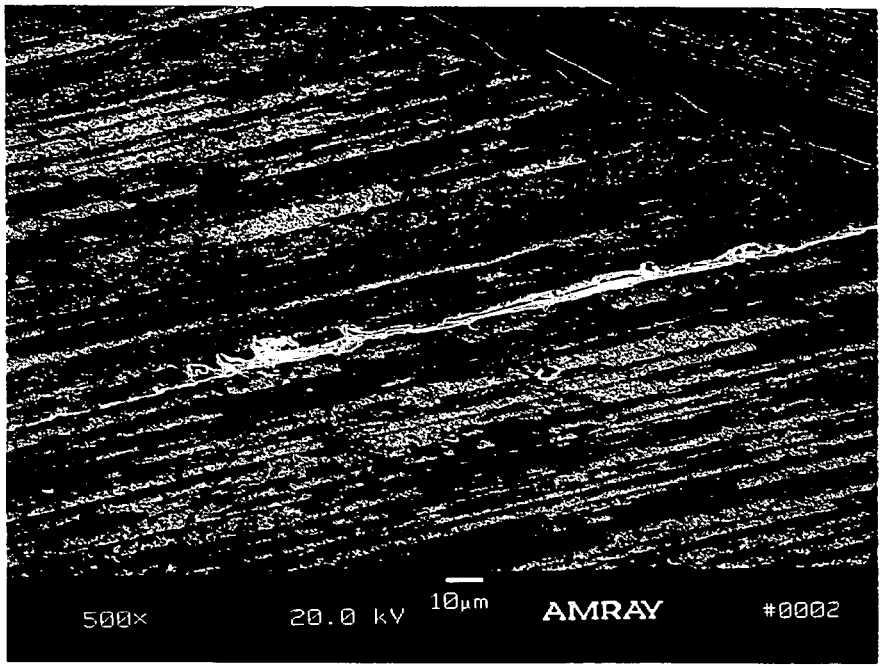
FIG. 3 is a photomicrograph showing monotonic and cyclic crack formation in a γTiAl alloy.
Figure 2:
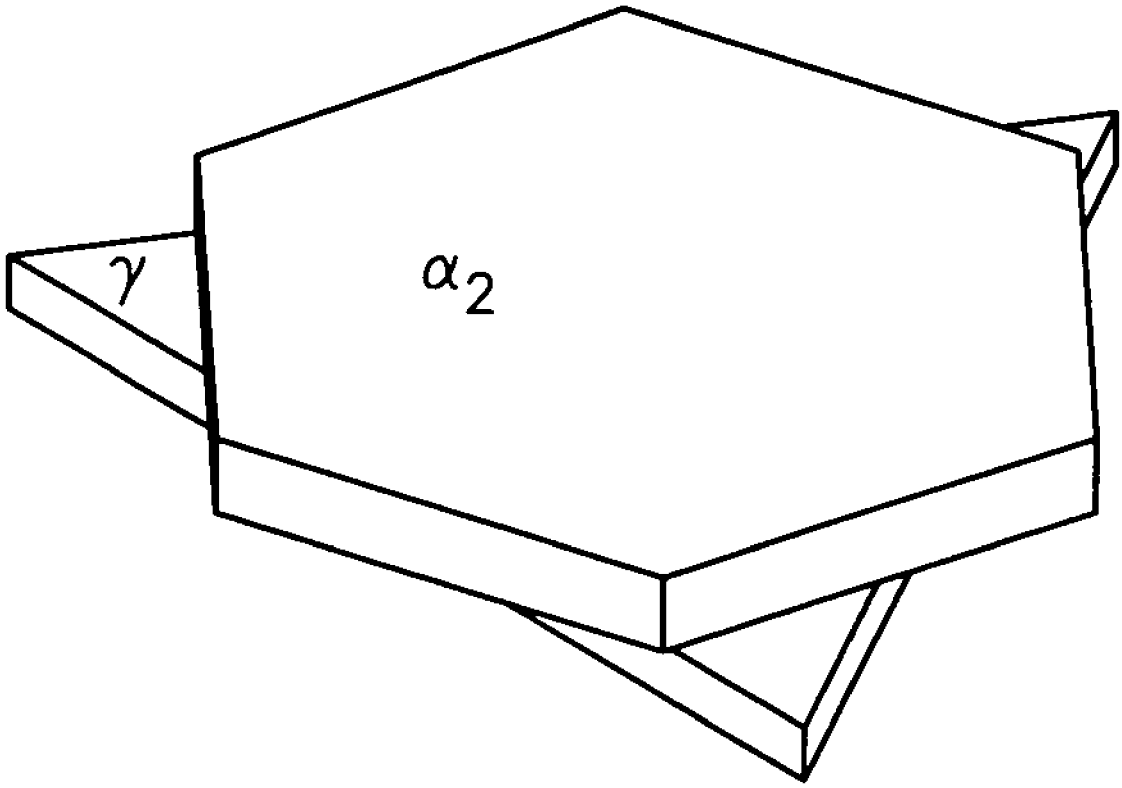
FIG. 2 is a schematic representation of a planar lamellar grain structure.
Figure 4:
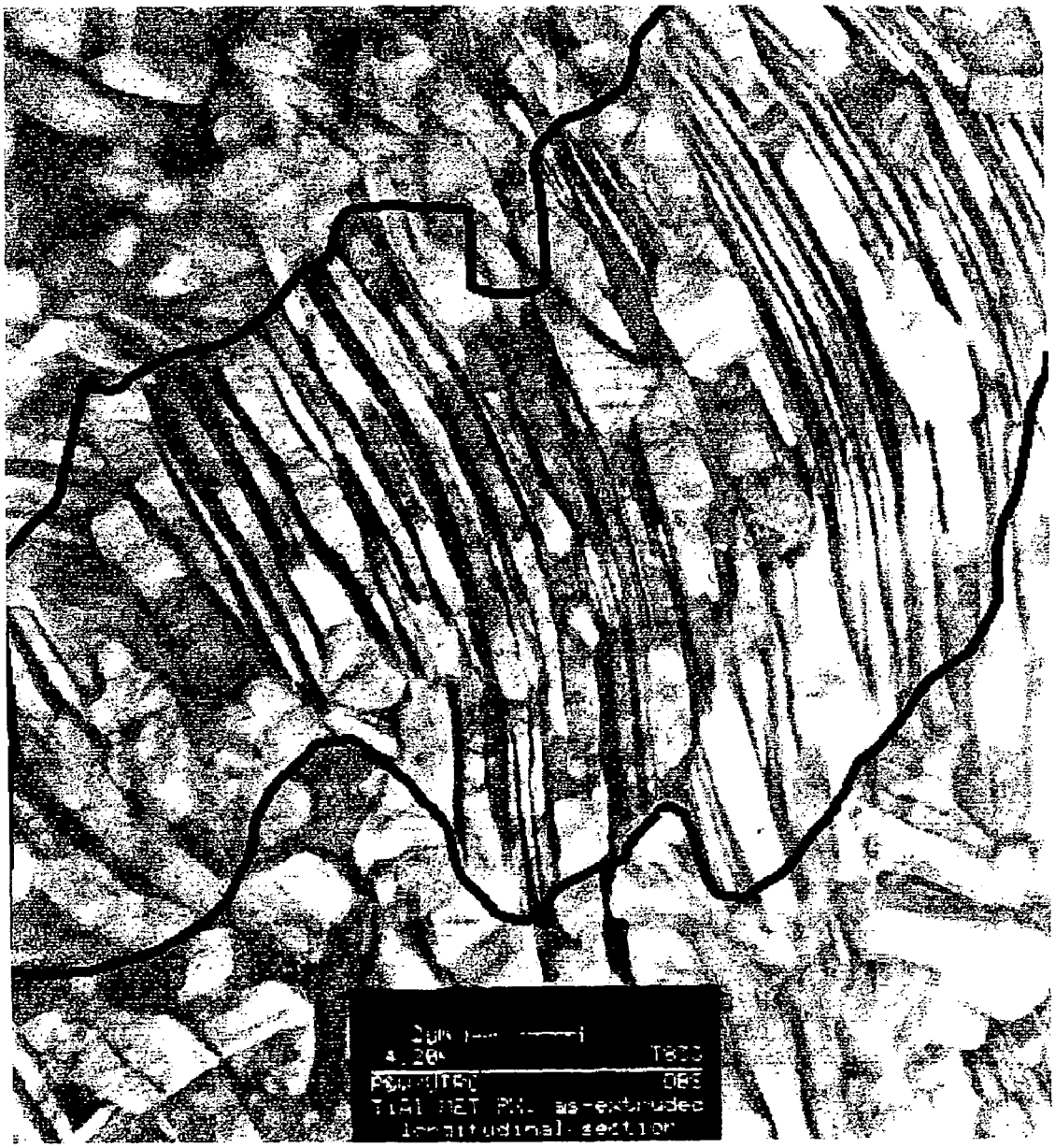
FIGS. 4-6 are photomicrographs of a γTiAl alloy having a microstructure in accordance with the present invention.
Figure 5:
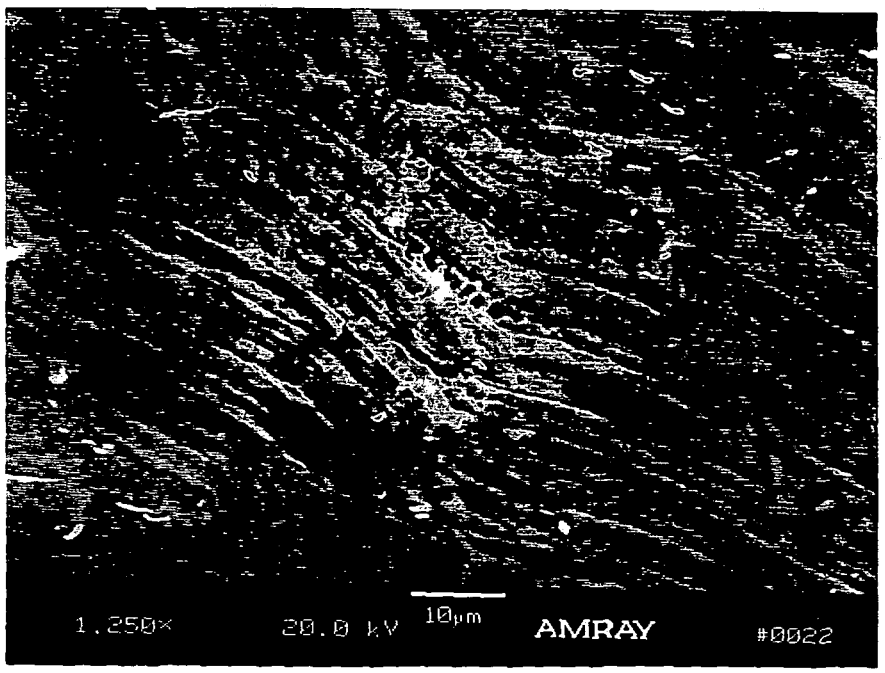
Figure 6:
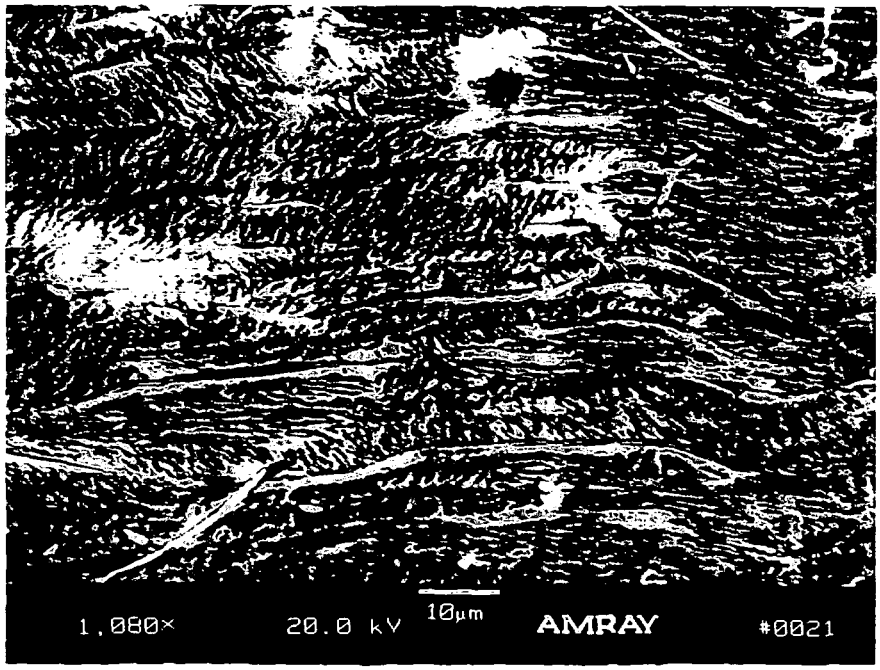

Referring now to FIGS. 4-6, a damage tolerant microstructure for a lamellar alloy in accordance with the present invention is shown. The alloy is a lamellar γTiAl alloy having a composition consisting of 46 wt % Al, 5-10 wt % Nb, 0.2 wt % boron, 0.2 wt % carbon, and the balance titanium and unavoidable impurities which has been extruded at a temperature of 1310 degrees Centigrade and an extrusion ratio of 100:1. The α transus temperature of this alloy is 1310 degrees Centigrade.

As can be seen from the foregoing discussion, lamellar alloys having a microstructure in accordance with the present invention, particularly γ TiAl alloys, are advantageous in that they will exhibit improved fatigue resistance and a higher threshold for small crack fracture resistance.

It is apparent that there has been provided in accordance with the present invention a damage tolerant microstructure for lamellar alloys which fully satisfies the objects, means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations which fall within the broad scope of the appended claims.

What is claimed is:

1. A lamellar γTiAl alloy having a microstructure with a plurality of lamellar colonies having a nonplanar morphology, said plurality of nonplanar lamellar colonies including a plurality of stacked layers with each stacked layer having a curved structure.

2. A lamellar γTiAl alloy according to claim 1, wherein each of said lamellar colonies exhibit a nonplanar morphology comprised of stacked nonplanar γTiAl and $\alpha Ti_3Al$ lamella.

3. A lamellar γTiAl alloy according to claim 1, further comprising a matrix and wherein said plurality of nonplanar lamellar colonies having said nonplanar morphology comprise at least 10 of the grains within said matrix.

4. A lamellar γTiAl alloy according to claim 3, wherein each of said plurality of grains having said nonplanar morphology has a size in the range of 0.8 to 1.09 microns.

5. A lamellar γTiAl alloy according to claim 1, wherein each of said lamellar colonies contains a multitude of lamella with irregularly repeating order.

6. A lamellar γTiAl alloy according to claim 1, wherein the microstructure includes γTiAl platelets having a triangular unit cell and a stack with γ twins and irregularly interspersed $\alpha_2Ti_3Al$ platelets.

7. A lamellar γTiAl alloy according to claim 1, further comprising a matrix and said lamellar colonies with said nonplanar morphology being located along outer edges of the matrix.

8. A lamellar γTiAl alloy according to claim 1, wherein said alloy has a composition consisting of 46 wt % Al, 5-10 wt % Nb, 0.2 wt % boron, 0.2 wt % carbon, and the balance titanium and unavoidable impurities.

* * * * *

UNITED STATES PATENT AND TRADEMARK OFFICE

CERTIFICATE OF CORRECTION

PATENT NO. : 7,479,194 B2
APPLICATION NO. : 11/200397
DATED : January 20, 2009
INVENTOR(S) : Daniel P. DeLuca It is certified that error appears in the above-identified patent and that said Letters Patent is hereby corrected as shown below:

In column 3, line 14, "$\alpha Ti_3Al$", should read --$\alpha_2 Ti_3Al$--.

In column 3, claim 3, line 19, "10", should read --10%--.

Signed and Sealed this

Second Day of June, 2009

John Doll

JOHN DOLL
*Acting Director of the United States Patent and Trademark Office*